US007712915B2

(12) United States Patent
Liu

(10) Patent No.: US 7,712,915 B2
(45) Date of Patent: May 11, 2010

(54) EMERGENCY LIGHT WITH A ROTATABLE ELECTRICAL PLUG

(76) Inventor: Yi-Chuan Liu, 14F, No. 14, Lane 110, Zhongping Road, Xinzhuang, Taipei (TW)

( * ) Notice: Subject to any disclaimer, the term of this patent is extended or adjusted under 35 U.S.C. 154(b) by 0 days.

(21) Appl. No.: 12/209,218

(22) Filed: Sep. 12, 2008

(65) Prior Publication Data

US 2010/0067213 A1 Mar. 18, 2010

(51) Int. Cl.
*F21L 13/00* (2006.01)

(52) U.S. Cl. ..... 362/183; 362/641

(58) Field of Classification Search ..... 362/640, 362/641, 183, 184, 647; 439/11, 13
See application file for complete search history.

(56) References Cited

U.S. PATENT DOCUMENTS

| | | | | |
|---|---|---|---|---|
| 5,806,961 | A * | 9/1998 | Dalton et al. | 362/183 |
| 6,489,746 | B1 * | 12/2002 | Pettinato | 320/111 |
| 7,405,671 | B2 * | 7/2008 | Sebescak | 340/628 |
| 2008/0094764 | A1 * | 4/2008 | Zhang et al. | 361/42 |
| 2009/0225486 | A1 * | 9/2009 | Wadsworth | 361/118 |

* cited by examiner

*Primary Examiner*—Thomas M Sember

(57) ABSTRACT

An emergency light includes a charging unit comprising a housing, a prong support rotatably secured to the housing, and a prong assembly fixedly secured to the prong support and being adapted to mate with a conventional electrical outlet; an illumination unit releasably disposed in the housing to be electrically connect to the charging unit; and a lamp indicator unit electrically connected to the charging unit and comprising a plurality of LEDs for indicating a charging state of the illumination unit. The rotation of the prong support, i.e., the prong assembly, is 90 degrees, 180 degrees, or 270 degrees. The illumination unit can be used as a flashlight after removing from the housing.

4 Claims, 10 Drawing Sheets

EMERGENCY LIGHT WITH A ROTATABLE ELECTRICAL PLUG

BACKGROUND OF THE INVENTION

1. Field of Invention

The invention relates to emergency lights and more particularly to such an emergency light having a rotatable electrical plug and a releasable illumination unit which can be used as a flashlight after removing.

2. Description of Related Art

Conventionally, an electrical plug is adapted to insert into an outlet (e.g., wall outlet) for obtaining electrical power therefrom. It is typical for an outlet mounted vertically on the wall. Hence, the electrical plug inserted into the outlet is also disposed vertically. It is also possible that an outlet is mounted obliquely on the wall. However, the electrical plug inserted into the outlet is not disposed vertically in this case. Hence, a device, connected to the electrical plug, may be disposed in an unstable orientation and may be easily disengaged from the electrical plug.

For overcoming the above problem, numerous suggestions for rotatable electrical plugs have been disclosed in prior patents. For example, U.S. Pat. No. 5,595,503 discloses a rotatable electrical plug and power cord.

Further, U.S. Pat. No. 7,220,010 discloses an emergency light. Thus, continuing improvements in the exploitation of emergency light having a rotatable electrical plug are constantly being sought.

SUMMARY OF THE INVENTION

It is therefore one object of the invention to provide an emergency light having a rotatable electrical plug and a releasable illumination unit which can be used as a flashlight after removing.

The above and other objects, features and advantages of the invention will become apparent from the following detailed description taken with the accompanying drawings.

DETAILED DESCRIPTION OF THE INVENTION

Figure 7:
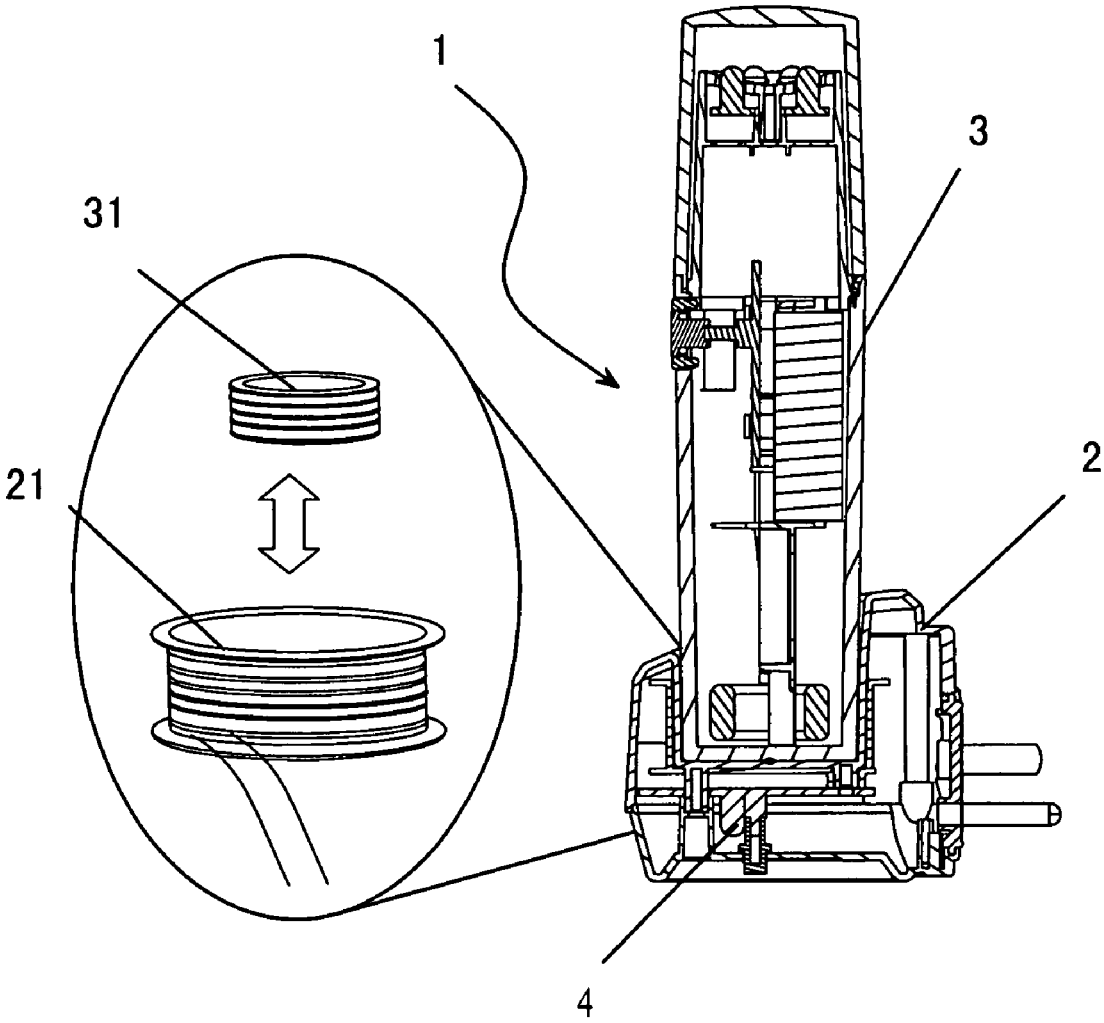
FIG. 7 is a longitudinal sectional view of the emergency light according to the invention.

Referring to FIG. 7, an emergency light 1 in accordance with a preferred embodiment of the invention comprises a charging unit 2, an illumination unit 3, and a lamp indicator unit 4. Each component is discussed in detail below.

Referring to FIGS. 1 to 6 in conjunction with FIG. 7, the charging unit 2 comprises a housing 22 and a prong support 23. The housing 22 comprises an upper first portion 24 and a mated lower second portion 25. Charging circuitry is mounted in the charging unit 2. The first portion 24 has a top slot 241 for the illumination unit 3 to releasably fasten therein for charging. The first portion 24 comprises mating members (e.g., posts) 24*a*. The second portion 25 comprises corresponding mating members (e.g., hollow cylinders) 25*a*. The posts 24*a* are adapted to securely insert into the cylinders 25*a* by snapping so that the first portion 24 and the second portion 25 can be releasably secured together. Alternatively, the mating members 24*a* and the corresponding mating members 25*a* are adapted to threadedly secure together. Both of the above fastenings are well known in the art and a detailed description thereof is therefore deemed unnecessary.

The first portion 24 further comprises an arcuate section 242 on the bottom edge, and an arcuate groove 243 disposed in and parallel to the arcuate section 242. Correspondingly, the second portion 25 further comprises an arcuate section 252 on the top edge, and an arcuate groove 253 disposed in and parallel to the arcuate section 252. A complete circle is formed by the arcuate sections 242, 252 when the first portion 24 and the second portion 25 are secured together.

The second portion 25 further comprises a stop member 251 provided proximate the center of the arcuate section 252, and a locking tab 254 provided in the stop member 251. The locking tab 254 and the stop member 251 are either formed integrally or formed separately. The prong support 23 comprises a circular prong support plate 231 having an annular flange 232 on the edge. The prong support 23 is retained in the circle formed by the arcuate sections 242, 252 when the first portion 24 and the second portion 25 are secured together. Moreover, the prong support 23 is adapted to rotate in the circle because the flange 232 is rotatably retained in another circle formed by the arcuate grooves 243, 253.

A prong assembly 26 is provided distal the housing 22. The prong assembly 26 comprises a live prong 261, a neutral prong 262, and a ground prong 263. The prongs 261, 62, and 63 are designed to snap into prong receiving apertures (not numbered) which extend through the support plate 231 so that the prongs 261, 62, and 63 can be electrically connected to a flexible electrical coupling means (not shown) which is in turn electrically connected to two receptacles (not shown) in the housing 22. The receptacles are in turn adapted to electrically connect to a charger plug (not shown) of the illumination unit 3. The provision of the flexible electrical coupling means permits rotation of the prong support 23 with respect to the housing 22. The prong assembly 26 is a three-prong version. It is appreciated that a two-prong version is also contemplated by the invention.

The support plate 231 further comprises a plurality of (four) equally spaced apart risers 233, 234, 235, and 236 (i.e., an angle of any two adjacent ones of the risers 233, 234, 235, and 236 is about 90 degrees). Each of the risers 233, 234, 235, and 236 has a convex edge facing the housing with a cut 233*a*, 234*a*, 235*a*, or 236*a* formed in the center of the convex edge. A stop tab 237 is formed between the risers 233 and 236.

Figure 1:
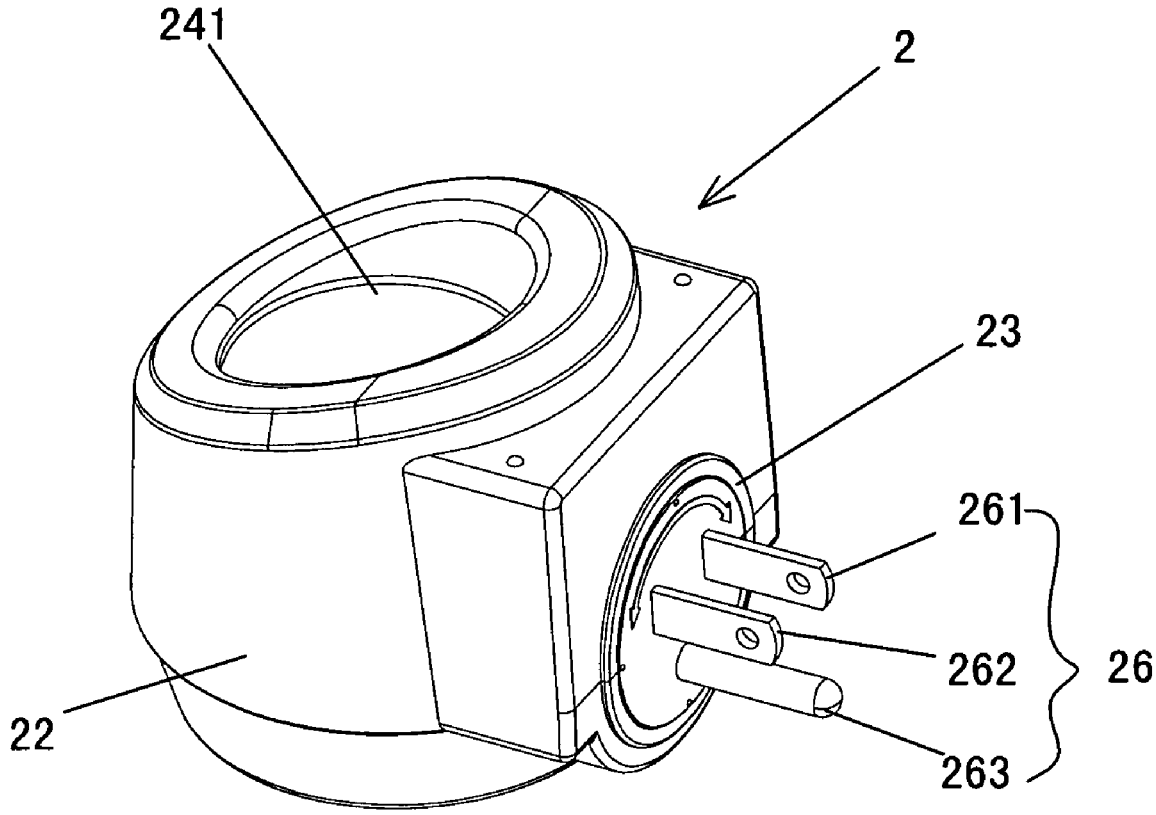
FIG. 1 is a perspective view of a preferred embodiment of a charging unit of an emergency light having a rotatable electrical plug according to the invention.
Figure 2:
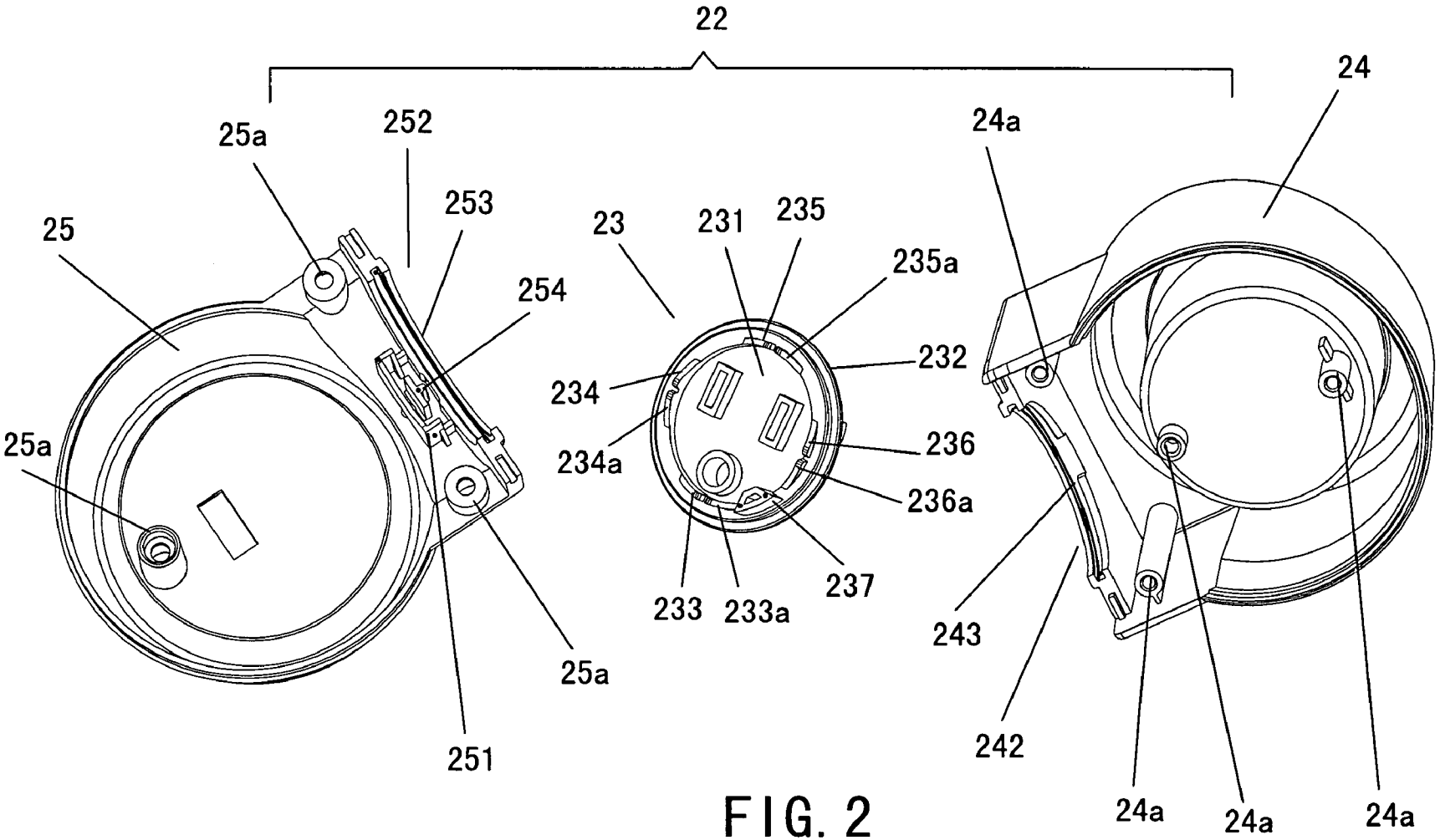
FIG. 2 is an exploded view of the charging unit of FIG. 1.
Figure 3A:
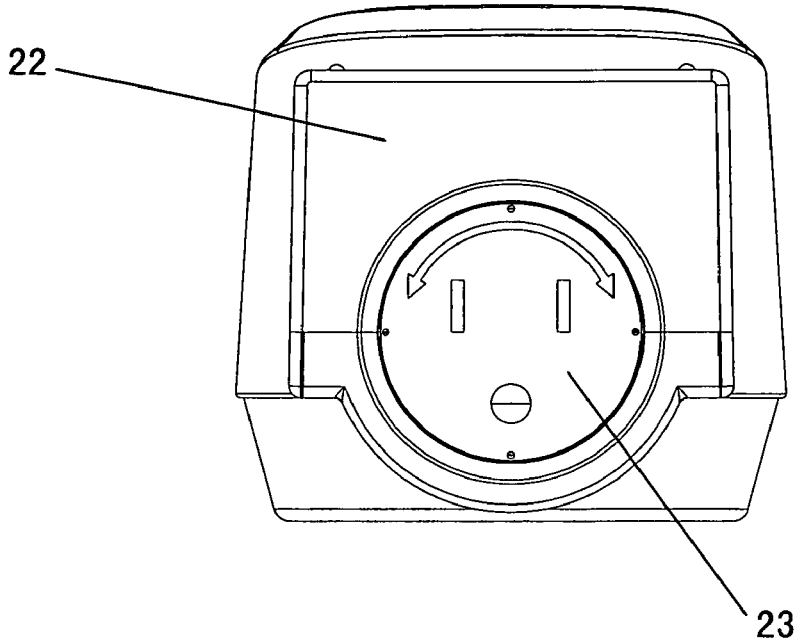
FIG. 3A is a front view of the charging unit of FIG. 1.
Figure 3B:
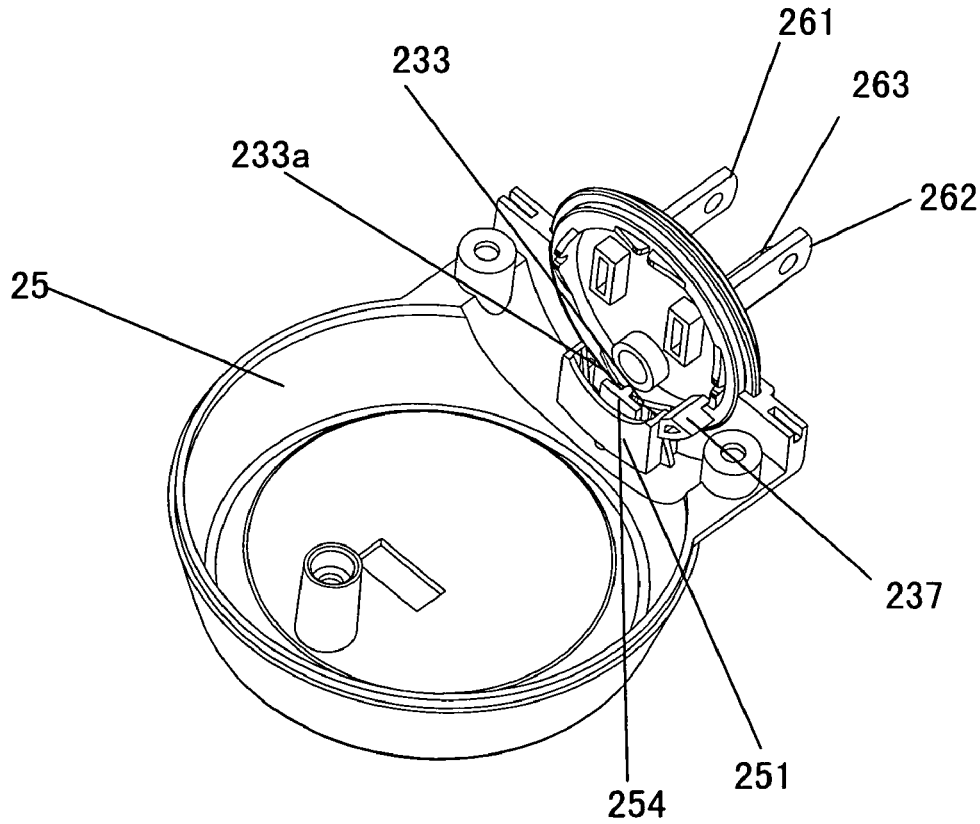
FIG. 3B is an exploded perspective view of the charging unit of FIG. 3A with the first portion of housing removed.

As shown in FIGS. 3A and 3B, the stop tab 237 is stopped at the right side of the stop member 251, the riser 233 is adjacent the stop member 251, and the locking tab 254 is lockingly disposed in the cut 233*a* in an inoperative position of the prong support 23. Moreover, the live prong 261 and the neutral prong 262 are disposed horizontally with the ground prong 263 disposed therebelow.

Figure 4A:
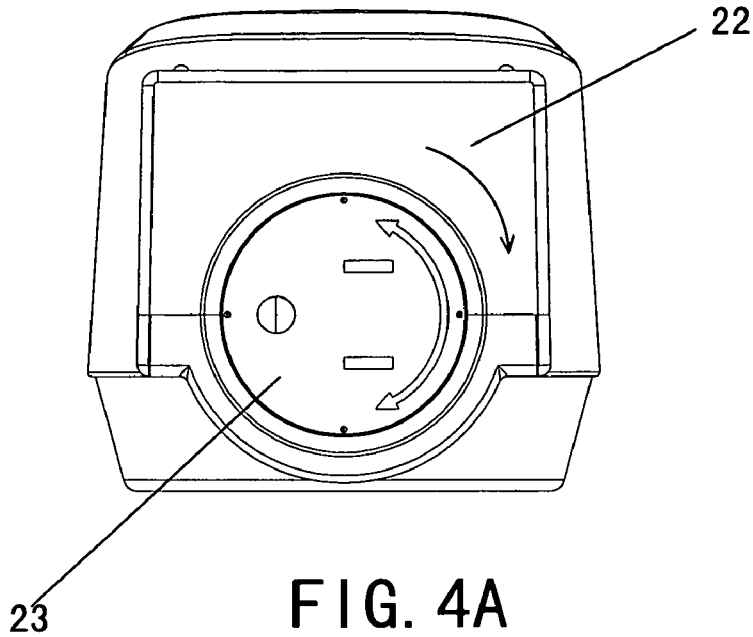
FIG. 4A is a view similar to FIG. 3A where the prong support has been rotated clockwise about 90 degrees.
Figure 4B:
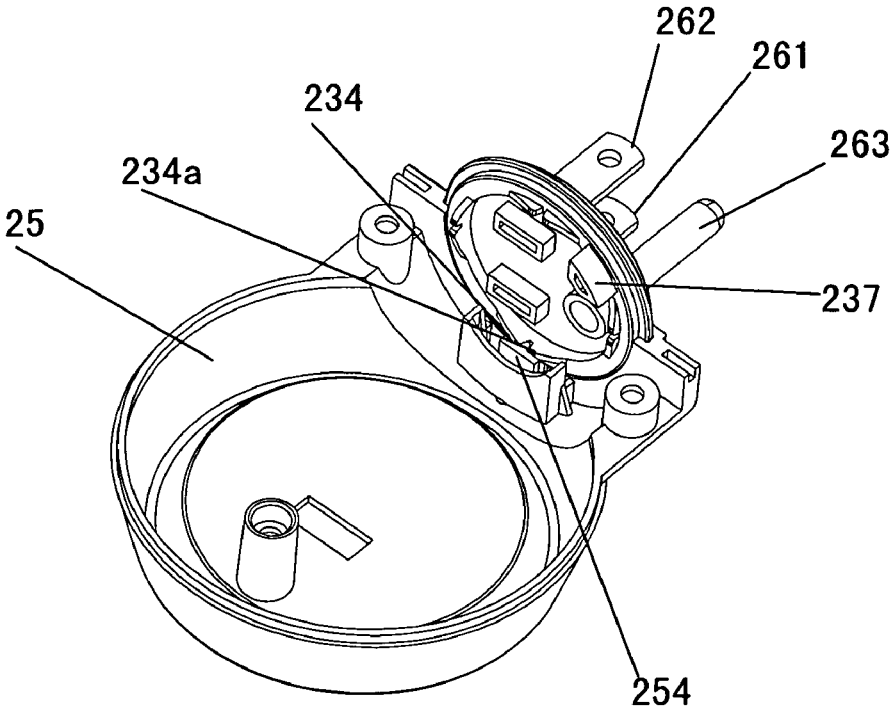
FIG. 4B is an exploded perspective view of the charging unit of FIG. 4A with the first portion of housing removed.

As shown in FIGS. 3B, 4A, and 4B, the prong support 23 has been rotated clockwise about 90 degrees with respect to the housing 22. The locking tab 254 has been deformed flexibly in the rotation due to the nature of its plastic material. As a result, the cut 233*a* rotates to disengage from the locking tab 254 until the riser 234 moves to the stop member 251 with the locking tab 254 lockingly disposed in the cut 234*a*. In this position, the neutral prong 262 is disposed above the live prong 261 vertically and the ground prong 263 is disposed therebetween.

Figure 5A:
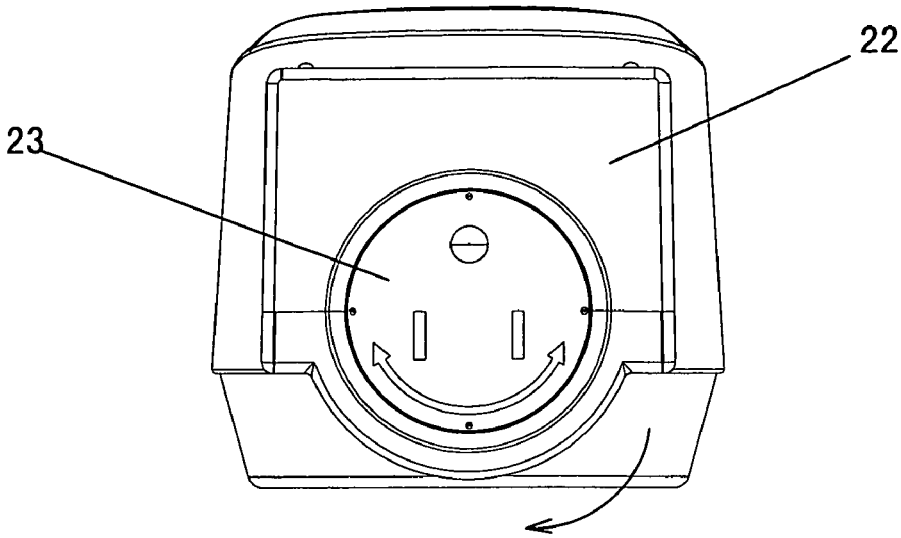
FIG. 5A is a view similar to FIG. 3A where the prong support has been rotated clockwise about 180 degrees.
Figure 5B:
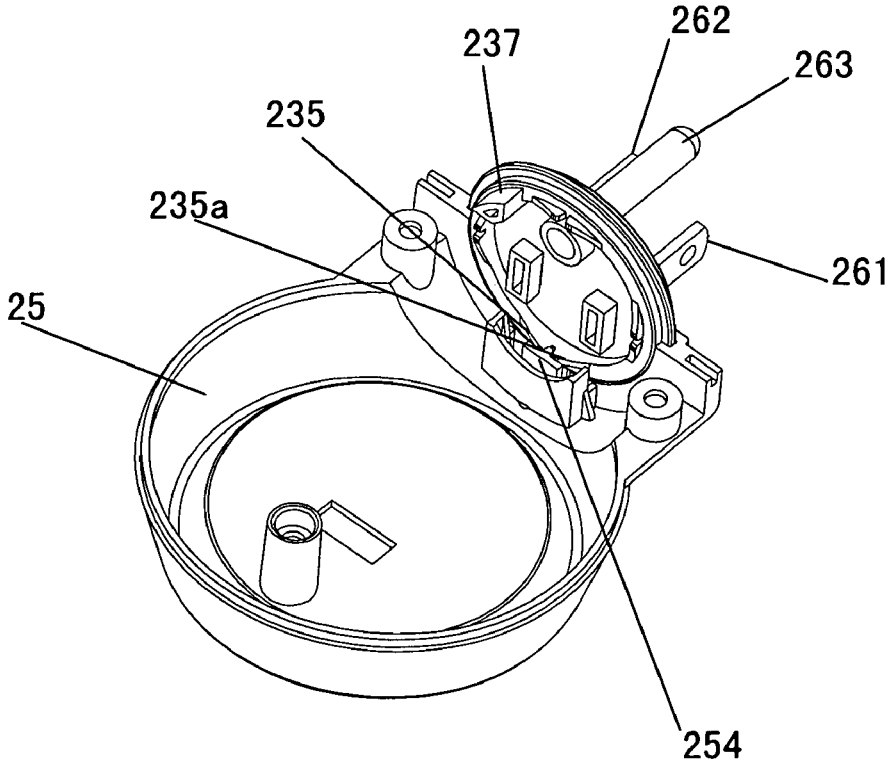
FIG. 5B is an exploded perspective view of the charging unit of FIG. 5A with the first portion of housing removed.

As shown in FIGS. 4B, 5A, and 5B, the prong support 23 has been rotated clockwise about 180 degrees with respect to the housing 22. As a result, the cut 234*a* rotates to disengage from the locking tab 254 until the riser 235 moves to the stop member 251 with the locking tab 254 lockingly disposed in the cut 235*a*. In this position, the live prong 261 and the neutral prong 262 are disposed horizontally with the ground prong 263 disposed thereabove.

Figure 6A:
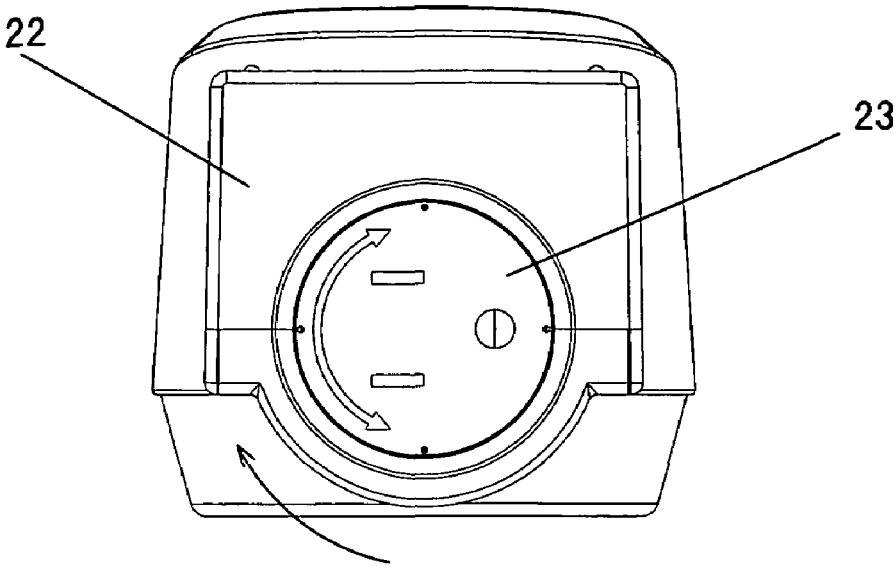
FIG. 6A is a view similar to FIG. 3A where the prong support has been rotated clockwise about 270 degrees.
Figure 6B:
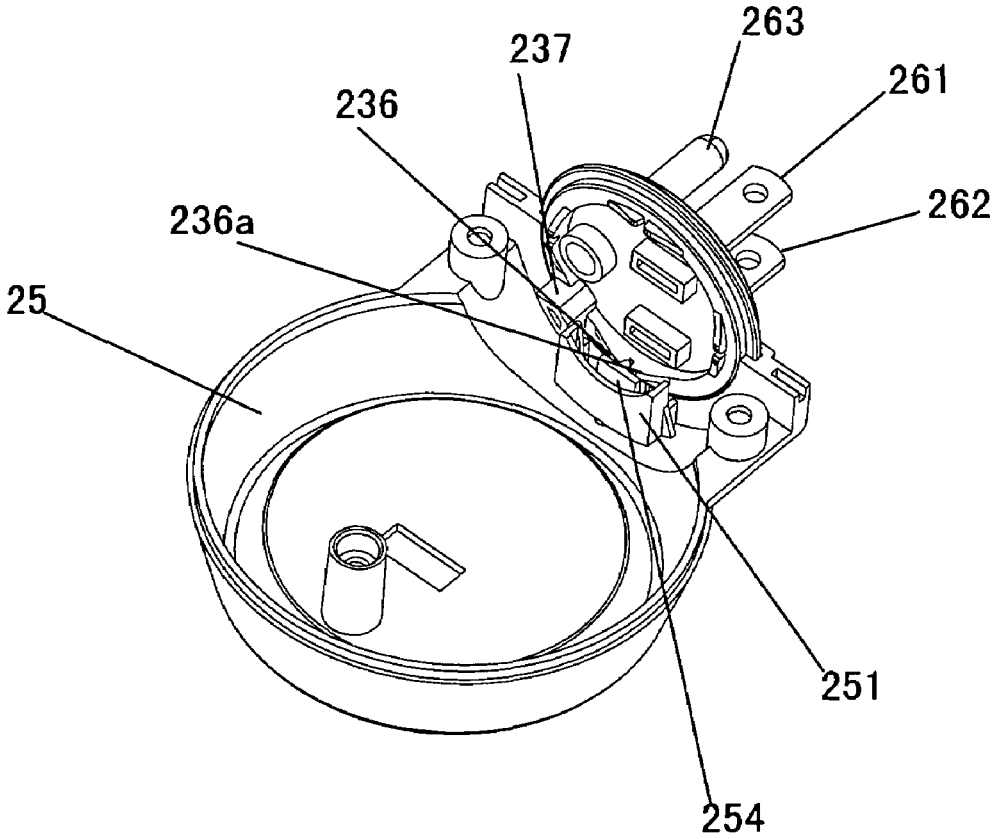
FIG. 6B is an exploded perspective view of the charging unit of FIG. 6A with the first portion of housing removed.

As shown in FIGS. 5B, 6A, and 6B, the prong support 23 has been rotated clockwise about 270 degrees with respect to the housing 22. As a result, the cut 235*a* rotates to disengage from the locking tab 254 until the riser 236 moves to the stop member 251 with the locking tab 254 lockingly disposed in the cut 236*a*. In this position, the stop tab 237 is stopped at the left side of the stop member 251. Also, the neutral prong 262 is disposed below the live prong 261 vertically and the ground prong 263 is disposed therebetween.

In the embodiment, the stop tab 237 is formed between the risers 233 and 236 so that the prong support 23 is adapted to rotate clockwise to cause the prongs 261, 262, and 263 to rotate clockwise with respect to the housing 22, and a counterclockwise rotation of the prong support 23 will return the prong support 23 to its inoperative position.

Alternatively, in other embodiments the stop tab 237 is formed between the risers 233 and 234 so that the prong support 23 is adapted to rotate counterclockwise to cause the prongs 261, 262, and 263 to rotate counterclockwise with respect to the housing 22, and a clockwise rotation of the prong support 23 will return the prong support 23 to its inoperative position.

It is envisaged by the invention that a rotation of the prong support 23 in the range no more than 270 degrees with respect to the housing 22 is permitted.

Figure 8:
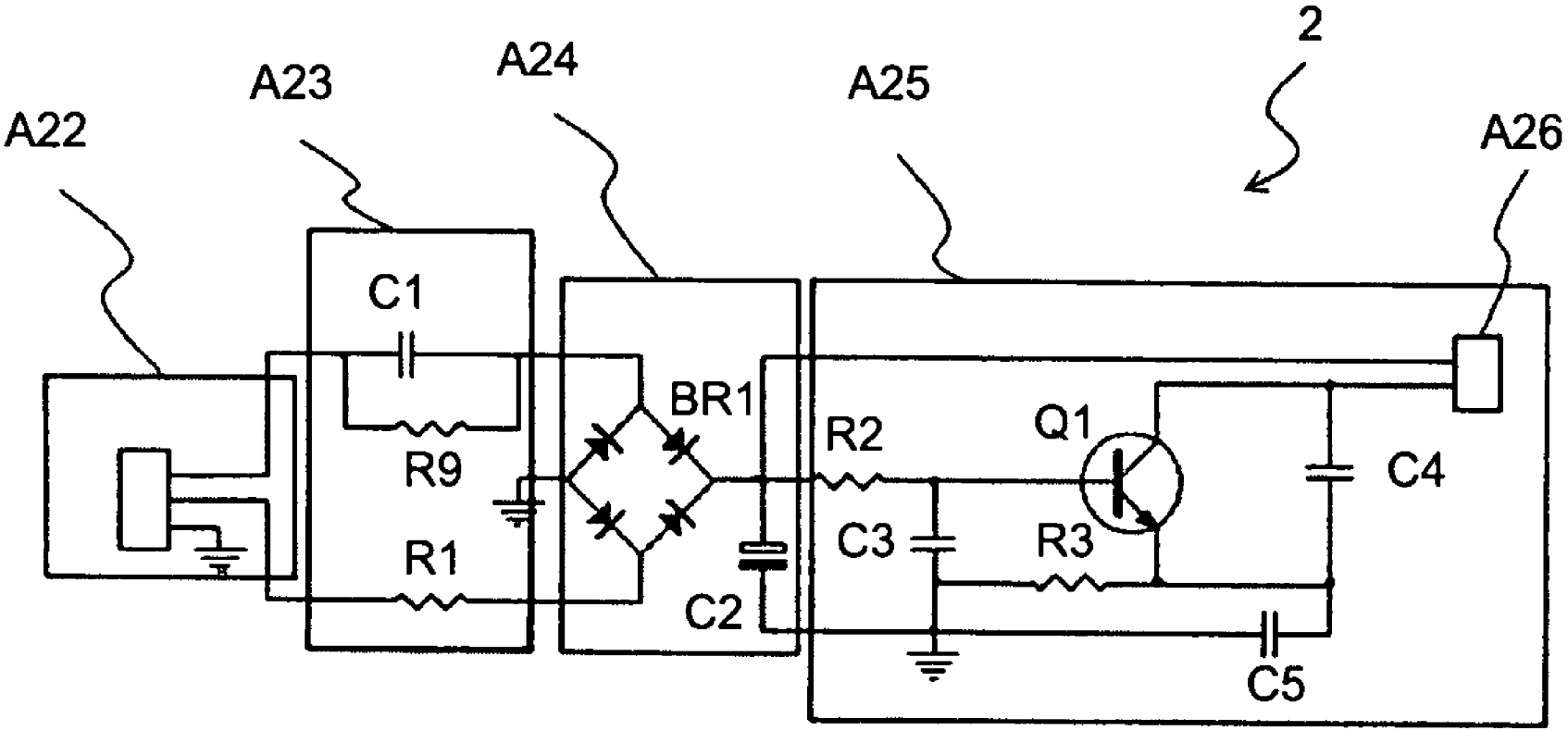
FIG. 8 is a detailed circuit representation of the charging unit of FIG. 7.
Figure 9:
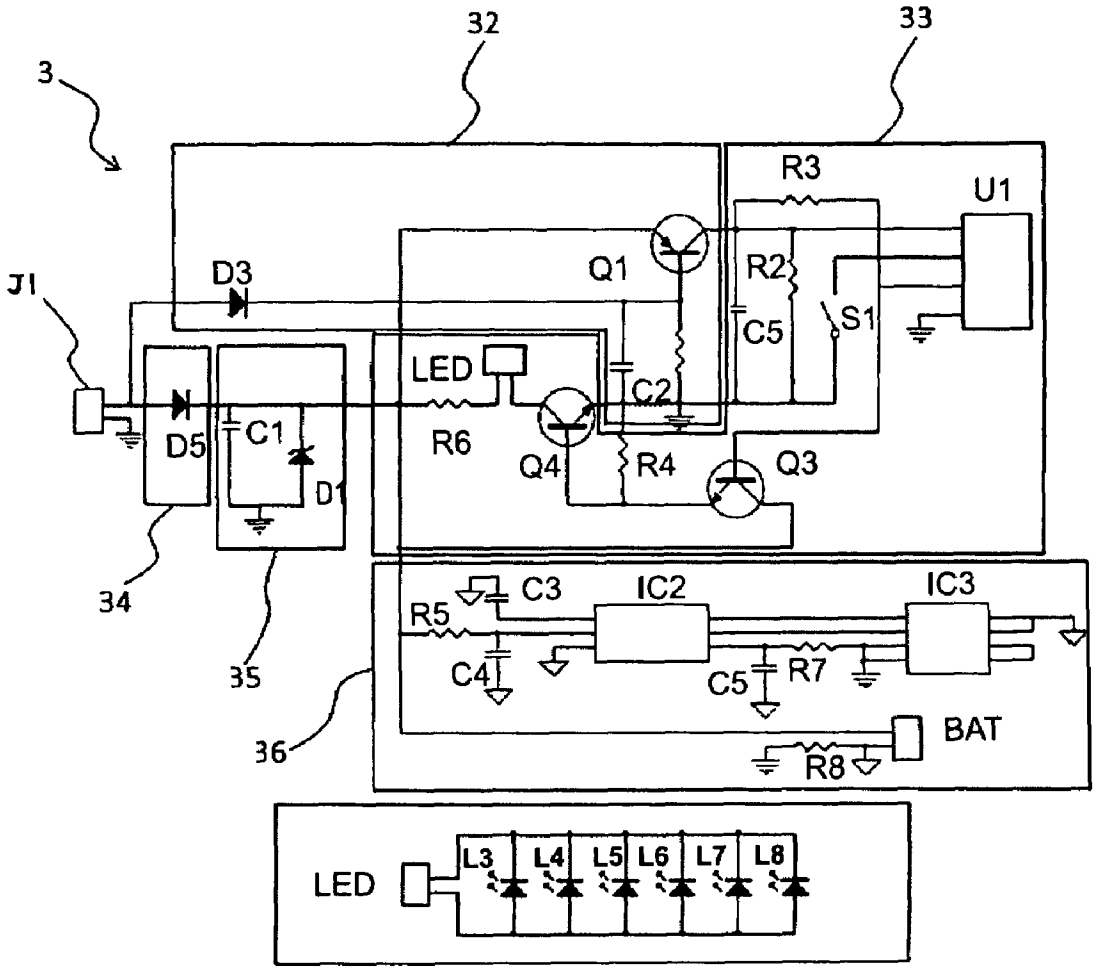
FIG. 9 is a detailed circuit representation of the illumination unit of FIG. 7.
Figure 10:
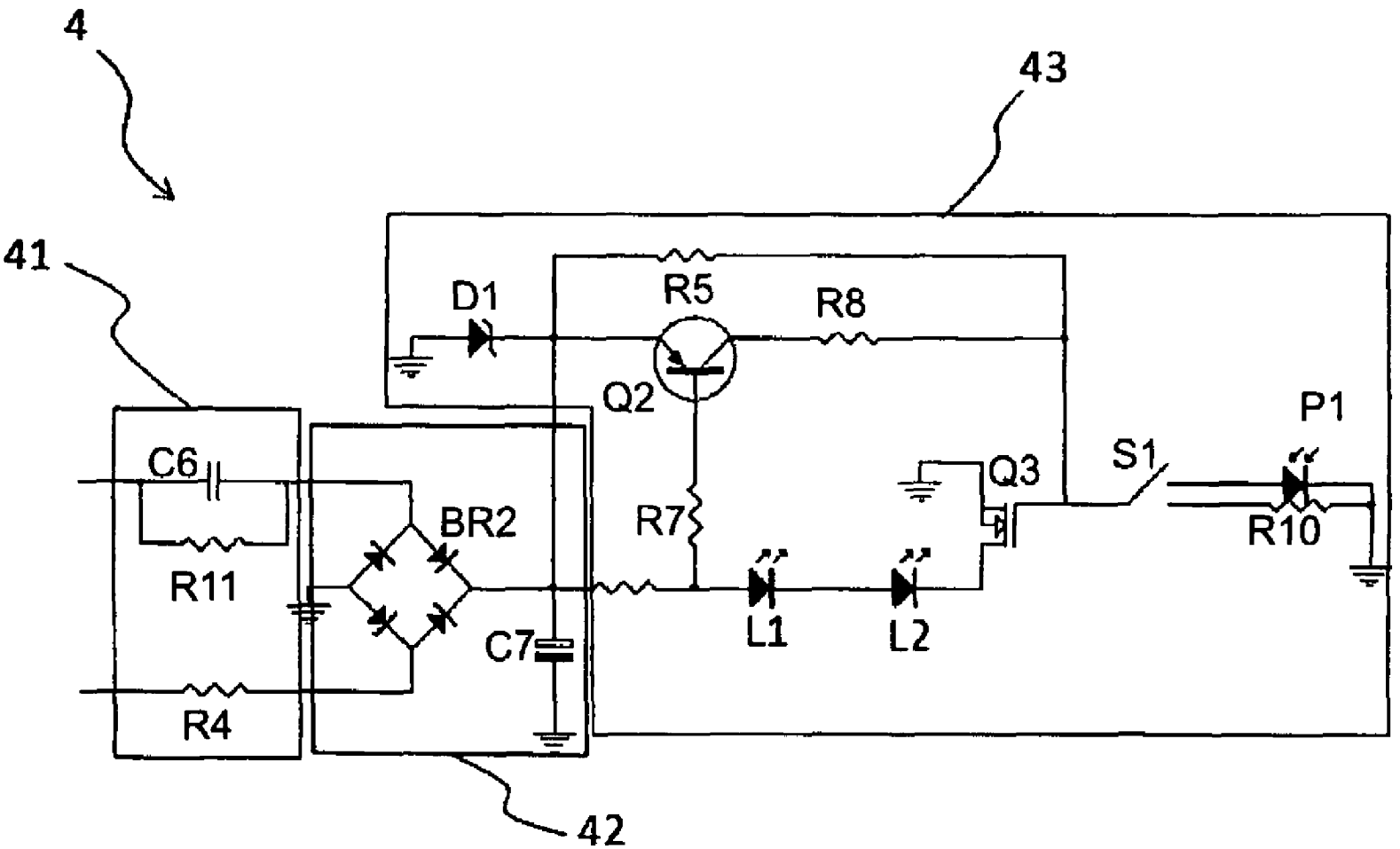
FIG. 10 is a detailed circuit representation of the lamp indicator unit of FIG. 7.

Referring to FIGS. 8 to 10 in conjunction with FIG. 7, the charging unit 2 is adapted to mate with, for example, a wall outlet to obtain AC (alternating current) power (e.g., 120V AC) therefrom.

The illumination unit 3 is shaped as a flashlight and can be used independently as detailed later. A large winding 21 is mounted in the charging unit 2 and a small winding 31 is mounted in the illumination unit 3. Alternatively, the small winding 31 is mounted in the charging unit 2 and the large winding 21 is mounted in the illumination unit 3. The large winding 21 is adapted to generate electromagnetic induction by co-acting with the small winding 31 for charging and other purposes as detailed later.

Referring to FIG. 8 specifically, the components of the charging unit 2 are discussed in detail below. The charging unit 2 comprises an input A22, a voltage decreasing circuit A23, a full-wave rectifier A24, a vibration circuit A25, and an output A26.

For example, AC 120V power is supplied from a wall outlet to the input A22. And in turn, voltage value of the AC power is decreased by the voltage decreasing circuit A23 which comprises series connected capacitor C1 and resistor R1 and resistor R9 which is parallel connected to capacitor C1. Voltage with decreased value is in turn rectified and filtered by the full-wave rectifier A24 which comprises a bridge rectifier BR1 for rectifying purpose and a capacitor C2 for filtering purpose. The vibration circuit A25 then generates a vibration signal to the output A26. Finally, the vibration signal is sent from the output A26 to the large winding 21. The vibration circuit A25 comprises capacitors C3, C4, C5, resistors R2, R3, and transistor Q1.

Referring to FIG. 9 specifically, the components of the illumination unit 3 are discussed in detail below. The illumination unit 3 comprises a jack J1, an electromagnetic induction control circuit 32, a display control circuit 33, a half-wave rectifier 34, a voltage stabilizing circuit 35, and a lithium battery protection circuit 36.

The small winding 31 is electrically connected to the jack J1. AC energy is transferred from the large winding 21 to the small winding 31 when an electromagnetic induction is generated. AC is then rectified by diode D3 so as to control the cut-off and conduction of transistors Q3, Q4. And in turn, on, off, and blinking of six light-emitting diodes (LEDs) L3, L4, L5, L6, L7, and L8 (see an enlarged view of "LED" on the bottom of FIG. 9) can be controlled by the transistors Q3, Q4 during charging. Preferably, dim, bright, and blinking of the LEDs L3 to L8 means inoperative, activation, and abnormal states thereof respectively.

The electromagnetic induction control circuit 32 comprises diode D3, resistor R1, capacitor C2, and transistor Q1. The display control circuit 33 comprises a switch S1, resistors R2, R3, R4, R6, capacitor C5, transistors Q3, Q4, an integrated circuit (IC) U1, and six LEDs L3, L4, L5, L6, L7, and L8. Note that the number of LEDs can be more or less in other embodiments.

Diode D5 of the half-wave rectifier 34 is for rectifying the AC energy supplied from the jack J1 to generate DC (direct current). Zener Diode D1 and capacitor C1 of the voltage stabilizing circuit 35 are for voltage stabilization and filter. Resistor R6 of the display control circuit 33 is for limiting voltage value. States of transistors Q3, Q4, and IC U1 can be controlled by switching the switch S1 to on or off by triggering. As a result, on, off, and blinking of the LEDs L3, L4, L5, L6, L7, and L8 can be controlled.

The lithium battery protection circuit 36 is electrically connected to the display control circuit 33. The lithium battery protection circuit 36 comprises resistors R5, R7, R8, capacitors C3, C4, C6, and ICs IC2, IC3. IC IC2 is for monitoring the charging voltage of a rechargeable lithium battery BAT in order to prevent over voltage or over current (i.e., overcharging) from occurring. Moreover, IC IC2 is for monitoring whether the lithium battery BAT is too low or a short circuit being occurred during discharge. The IC IC3 is adapted to disable the circuit for the protection of the lithium battery BAT if any irregularity occurs.

An individual may insert the prongs 261, 262, and 263 into, for example, a wall outlet to activate the charging unit 2 for charging the illumination unit 3 by transferring AC energy by electromagnetic induction from the large winding 21 (in the charging unit 2) to the small winding 31 (in the illumination unit 3). The charging will be stopped when the rechargeable lithium battery BAT is fully charged. The illumination unit 3 will come on automatically to cause the LEDs L1 to L6 to emit light as sensed by a sensor (not shown) when experiencing a power outage, i.e., an absence of AC. Further, the sensor can disable the illumination unit 3 when it senses a termination of the activating condition, such as the restoration of AC. Still further, the illumination unit 3 can be removed from the charging unit 2 to be used as a flashlight. Preferably, the LEDs L3 to L8 of the illumination unit 3 emit light (i.e., turned on) immediately after removing from the charging unit 2. Still preferably, the sensor may instruct the LEDs L3 to L8 of the illumination unit 3 to stop emitting light (i.e., turned off) immediately after placing the illumination unit 3 in the charging unit 2 and electrically connecting thereto.

Referring to FIG. 10 specifically, the components of the lamp indicator unit 4 are discussed in detail below. The lamp indicator unit 4 is electrically connected to the charging unit 2 and comprises a voltage decreasing circuit 41, a full-wave rectification circuit 42, and a lighting module 43.

The voltage decreasing circuit 41 is adapted to decrease voltage value of the supplied AC 120V. Voltage with decreased value is then supplied to full-wave rectifier BR2 and capacitor C7 of the full-wave rectification circuit 42 for rectification. And in turn, Zener diode D1 of the lighting module 43 is adapted to generate a constant DC (e.g., AC 11V). Resistors R5, R6, R6, R8, R10, switch S1, photodiode P1, and transistors Q2, Q3 of the lighting module 43 together are adapted to control on, off, and blinking of LEDs L1, L2 as an indication of charging state. Preferably, dim, bright, and blinking of the LEDs L1, L2 represent normal (i.e., not being charged), abnormal, and charging states of the charging unit 2 or the illumination unit 3.

While the invention herein disclosed has been described by means of specific embodiments, numerous modifications and variations could be made thereto by those skilled in the art without departing from the scope and spirit of the invention set forth in the claims.

What is claimed is:

1. An emergency light comprising:

a charging unit (2) comprising a housing (22), a prong support (23) rotatably secured to the housing (22), and a prong assembly (26) fixedly secured to the prong support (23) and being adapted to mate with a conventional electrical outlet;

an illumination unit (3) releasably disposed in the housing (22) to be electrically connect to the charging unit (2); and a lamp indicator unit (4) electrically connected to the charging unit (2) and comprising a plurality of LEDs (L1, L2) for indicating a charging state of the illumination unit (3), wherein the housing (22) comprises a first housing portion (24) including an open charging slot (241) for fastening the illumination unit (3), and a first arcuate section (242) on the edge, and a mated second housing portion (25) including a second arcuate section (252) on the edge, a stop member (251) disposed proximate the center of the arcuate section (252); and the prong support (23) comprises a peripheral stop tab (237) extending toward the second housing portion (25) so that the rotation of the prong support (23) is stopped when the stop tab (237) contacts the stop member (251).

2. The emergency light of claim 1, wherein the prong support (23) further comprises equally spaced apart first, second, third, and fourth risers (233, 234, 235, and 236) proximate the edge and opposing the prong assembly (26), each of the first, second, third, and fourth risers (233, 234, 235, and 236) having a convex edge facing the housing (22) and a cut (233*a*, 234*a*, 235*a*, or 236*a*) in the center of the convex edge; the second housing portion (25) further comprises a flexible locking tab (254) in the center of the stop member (251), the locking tab (254) being lockingly engaged with the cut (233) in an inoperative position of the prong support (23); and the cut (233*a*) is adapted to disengage from the locking tab (254) by rotating the prong support (23).

3. The emergency light of claim 2, wherein the stop tab (237) is disposed either between the first riser (233) and the second riser (234) so that the prong support (23) is adapted to rotate counterclockwise with respect to the housing (22) or between the first riser (233) and the fourth riser (236) so that the prong support (23) is adapted to rotate clockwise with respect to the housing (22); and the rotation of the prong support (3) is one of 90 degrees, 180 degrees, and 270 degrees.

4. The emergency light of claim 2, wherein the first housing portion (24) further comprises a first arcuate groove (243) proximate and parallel to the first arcuate section (242), the second housing portion (25) further comprises a second arcuate groove (253) proximate and parallel to the second arcuate section (252), and the prong support (23) further comprises an annular flange (232) on the edge facing the housing (22), the flange (232) being rotatably retained in the first and second arcuate grooves (243, 253).

* * * * *